United States Patent [19]

Allen

[11] Patent Number: 4,699,182

[45] Date of Patent: Oct. 13, 1987

[54] FRINGE REDUCTION MECHANISM

[75] Inventor: Danny H. Allen, Greensboro, N.C.

[73] Assignee: Burlington Industries, Inc., Greensboro, N.C.

[21] Appl. No.: 845,493

[22] Filed: Mar. 31, 1986

Related U.S. Application Data

[63] Continuation of Ser. No. 616,682, Jun. 4, 1984, abandoned.

[51] Int. Cl.[4] ..... D03D 49/70

[52] U.S. Cl. ..... 139/429; 139/194; 139/302

[58] Field of Search ..... 139/352, 302, 303, 429, 139/430, 450, 291 C, 435, 194

[56] References Cited

U.S. PATENT DOCUMENTS

| | | | |
|---|---|---|---|
| 2,930,411 | 3/1960 | Calhoun | 139/352 |
| 3,147,778 | 9/1964 | Reyes | 139/303 |
| 3,451,440 | 6/1969 | Golobart | 139/303 |
| 3,658,098 | 4/1972 | Mullekom | 139/194 |
| 3,744,533 | 7/1973 | Yano et al. | 139/430 |
| 3,903,932 | 9/1975 | Camprubi | 139/303 |
| 3,938,561 | 2/1976 | Scheffel | 139/435 |
| 4,185,667 | 1/1980 | Kendrick . | |
| 4,296,783 | 10/1981 | Ichimatsu | 139/430 |
| 4,387,744 | 6/1983 | Newcomb . | |
| 4,404,996 | 9/1983 | Manders | 139/194 |
| 4,448,223 | 5/1984 | Deborde et al. | 139/435 |
| 4,498,504 | 2/1985 | Allen et al. | 139/435 |
| 4,541,460 | 9/1985 | Mullekom | 139/302 |
| 4,570,683 | 2/1986 | Griffith | 139/302 |

*Primary Examiner*—Henry S. Jaudon

*Attorney, Agent, or Firm*—Nixon & Vanderhye

[57] ABSTRACT

In an air jet loom having a movable suction conduit operatively connected to a suction source, a particular fringe cutting mechanism and waste fringe removal mechanism are provided that minimize yarn waste and minimize loom downtime. The fringe cutting mechanism is mounted upstream of the loom temple with respect to the direction of fabric movement, and is actuated by the movement of the reed of the loom as the reed moves in a downstream path of movement. The movable suction conduit, in addition to capturing the picks from the main jet of the loom, comprises the waste removal mechanism for removing cut fringe so that no fringe binder yarns, or the like, are necessary. The fringe cutter includes an anvil block with a lifting stiff wire extending outwardly from it to lift fringe yarn to be cut onto the block surface so that it is engaged by a cutting blade rotated into contact with the block. The suction conduit includes a nozzle having an entrance diameter large enough to guide errant picks into the high suction throat of the nozzle, the throat diameter being such that tension on the leading ends of the filling yarn is maximized. The nozzle is placed immediately adjacent the confuser exit so that the pick fringe length can be minimized.

27 Claims, 15 Drawing Figures

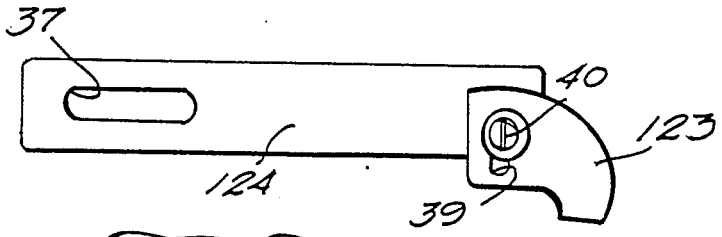
Fig. 8
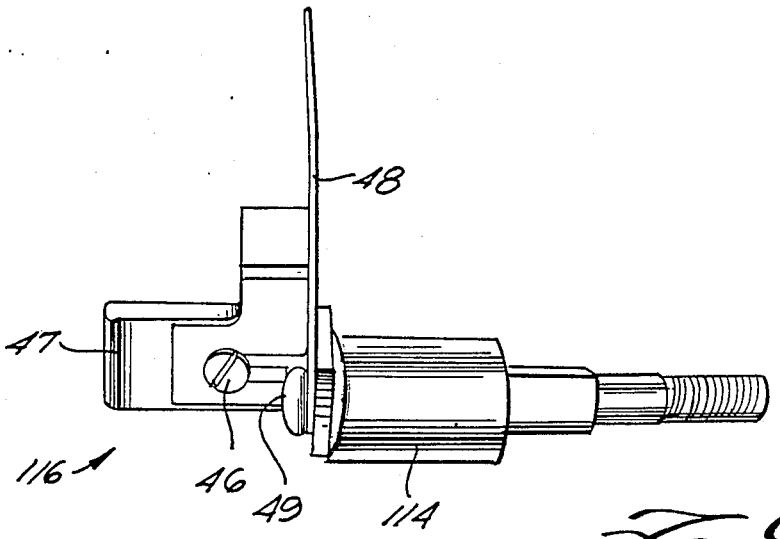
Fig. 9
Fig. 10
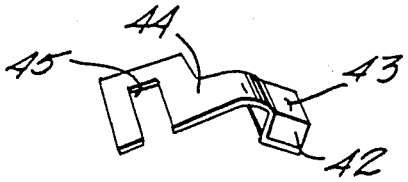

Fig. 12
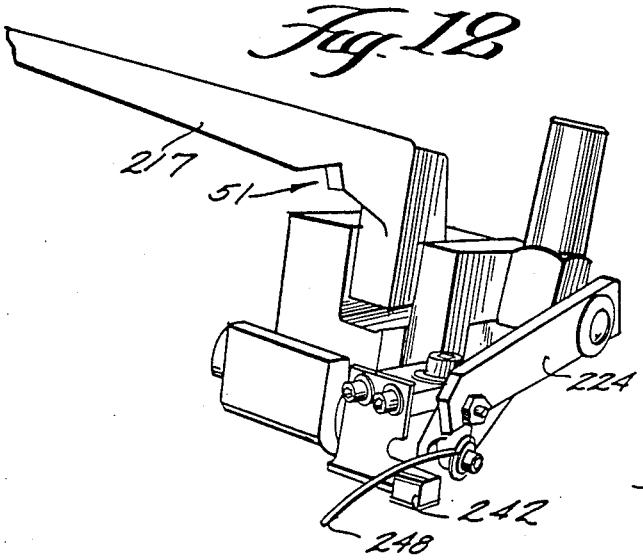
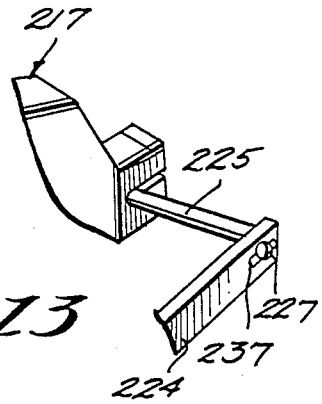
Fig. 13
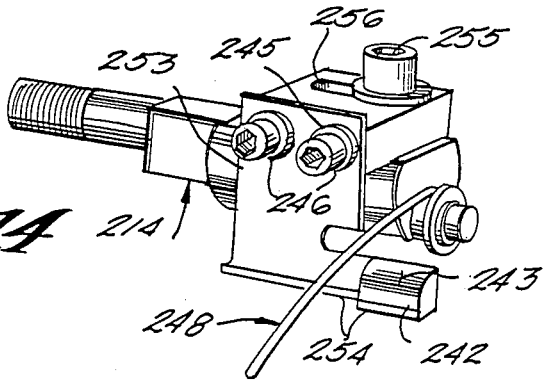
Fig. 14
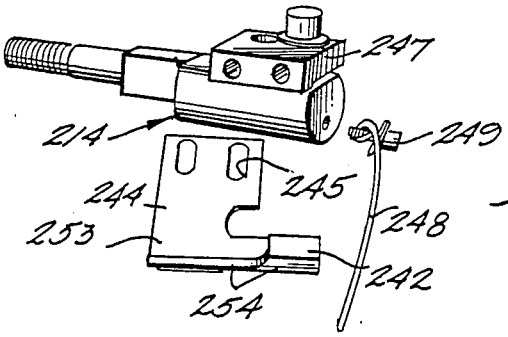
Fig. 15

FRINGE REDUCTION MECHANISM

This is a continuation of application Ser. No. 616,682 filed June 4, 1984, now abandoned.

BACKGROUND AND SUMMARY OF THE INVENTION

Air jet looms having suction conduits which move with the reed in the upstream and downstream directions (with respect to the direction of fabric movement) are in common use today, manufactured by a number of manufacturers. Typical or such looms are the Elitex P series of air jet looms manufactured by the Zbrojovka National Corporation of Vsetin, Czechoslovakia.

While such air jet looms are in general quite productive and efficient, there are a number of drawbacks associated therewith. One major drawback is the necessity of using outer or auxiliary binding yarns (ends) for removal of the waste fringe yarns. Typically 8 auxiliary binding ends are used first to bind and then to carry away the fringe yarns. These auxiliary ends comprise a great deal of waste, and require a number of machine elements to handle and dispose of them.

Another significant disadvantage of conventional air jet looms of the type described above is the necessity for relatively long fringe lengths. For certain fabric widths up to 9% of the filling yarn length becomes waste. A related disadvantage of prior art commercial structures is that errant filling yarns or picks may shoot outside the suction nozzle entirely, thereby producing fabric quality problems caused by slack filling yarns, and often leading to shutdown of the loom for adjustments.

According to the present invention the drawbacks associated with conventional air jet looms of the type described are eliminated or minimized. In particular, according to the present invention the auxiliary binder ends are eliminated entirely, the amount of filling fringe waste is reduced by about 30–40%, and the probability of errant picks not being captured by the suction nozzle is virtually eliminated.

The problems inherent in commercial air jet looms of the type described above are dealt with by providing a particular interaction and operation between the fringe cutting mechanism and the suction conduit, and by redesigning the suction conduit nozzle end.

According to the present invention, the fringe cutting mechanism includes a cutting element which is mounted so that it is upstream of the temple (with respect to the direction of fabric movement), and adjacent the suction conduit nozzle when the suction conduit is in its downstreammost position. The reed, and the actuating arm associated with the loom for effecting the fringe cutting, are provided with surface means such that the fringe cutter is actuated in response to movement of the reed in the downstream direction (triggering occurring just before the reed reaches its downstreammost position). In providing such a structure it is possible to utilize the already existing suction conduit as the sole means for carrying away the waste fringe, while simultaneously eliminating the auxiliary binder ends and their associated heddles, drop wires, tension discs, yarn packages, package supports, and take-up wheels, all of which are normally associated with such a loom.

Further, according to the present invention the fringe cutting mechanism includes a cutting block which the rotating arm—with cutting element—moves into operative association with, plus an optional but preferred fringe lifting means which extends outwardly from the block in operative association therewith. The lifting means preferably comprises a stiff wire which provides a ramp surface for guiding fringe to be cut into proper operative association with the cutting block.

The nozzle of the suction conduit according to the present invention is designed so that it has an entrance diameter significantly greater than the entrance diameter of the conventional nozzle, yet has a throat diameter which is less, the conical mouth of the nozzle providing a taper between the entrance and the throat. The larger entrance adequately covers the exit aperture of the confuser so that errant picks will be guided into the high suction throat, and the reduction in throat diameter increases the nozzle air speed and thus the tension on the leading ends of the filling yarn. Further, since the auxiliary binder ends and heddles associated with conventional looms of this type are no longer necessary, the nozzle entrance may be placed significantly closer to the confuser exit. The closer nozzle location and increased filling yarn tension work together to permit minimizing the filling yarn fringe length.

It is the primary object of the present invention to provide a shuttleless loom having minimized material waste, and maximized reliability and efficiency. This and other objects of the invention will become clear from an inspection of the detailed description of the invention, and from the appended claims.

BRIEF DESCRIPTION OF THE DRAWINGS

FIG. 8 is a side view of an exemplary fringe cutting means arm and cutting element according to the present invention;

FIG. 9 is a top plan view of the stationary components of the fringe cutting mechanism of the loom of FIGS. 5–7, shown in conjunction with the temple stub;

FIG. 10 is a detail perspective view of the stationary cutting block of the apparatus of FIG. 9;

FIG. 12 is a detail perspective view of the fringe cutting mechanism of the embodiment illustrated in FIG. 11;

FIG. 13 is a detail perspective view showing the interconnection between the actuating arm and cutting element supporting arm of the mechanism of FIG. 12;

FIG. 14 is a front perspective view of the stationary components of the cutting mechanism of the FIGS. 11 and 12 embodiment, shown in conjunction with the temple stub; and FIG. 15 is an exploded view of the structure of FIG. 14.

DETAILED DESCRIPTION OF THE DRAWINGS

The Prior Art

Figure 1:
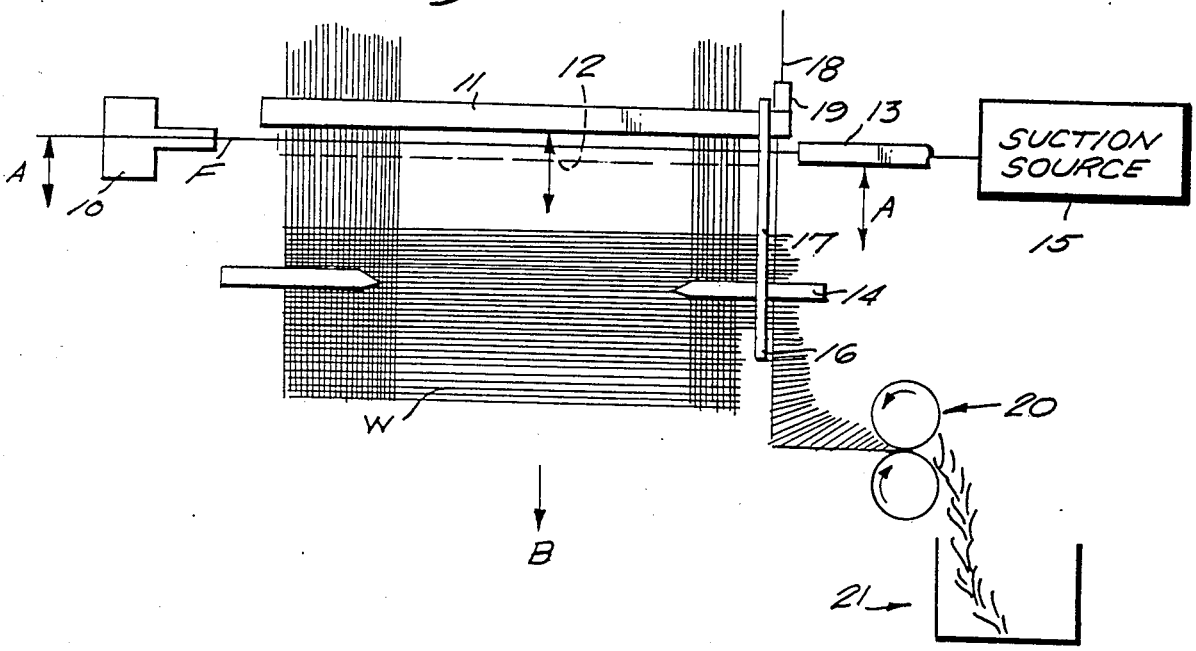
Fig. 1 PRIOR ART
FIG. 1 is a schematic top plan view of a prior art air jet loom having a movable suction conduit, and auxiliary ends for binding waste filling fringe.

FIG. 1 schematically illustrates a conventional air jet loom with moving suction conduit, such as an Elitex P series loom. The reed 11, reciprocates in dimension A since it is mounted to a reciprocating loom lay (not shown). The loom includes a conventional confuser 12 which guides the filling yarn (or pick) F to the suction conduit 13. A conventional filling detector (not shown) is provided in the last confuser rib. The suction conduit 13 and the temple 14 are mounted on the opposite side of the reed 11, and fabric W being woven, from the main jet 10.

The suction conduit 13 is also mounted for movement in dimension A (as by connecting it to the reciprocating loom lay), and it is operatively connected, as by a flexible hose (not shown) to a suction source 15. Downstream of the temple 14 in the direction B of woven fabric W movement is the fringe cutting mechanism 16, which is activated by an arm 17 interconnected between it and the movable reed 11. A plurality of auxiliary binder ends (usually 8) 18 pass through heddles 19 and reed 11 and ultimately to the draw-off wheels 20, to be ultimately disposed of in waste receptacle 21. The auxiliary binder ends 18 provide the means for carrying off the severed fringe.

Figure 2:
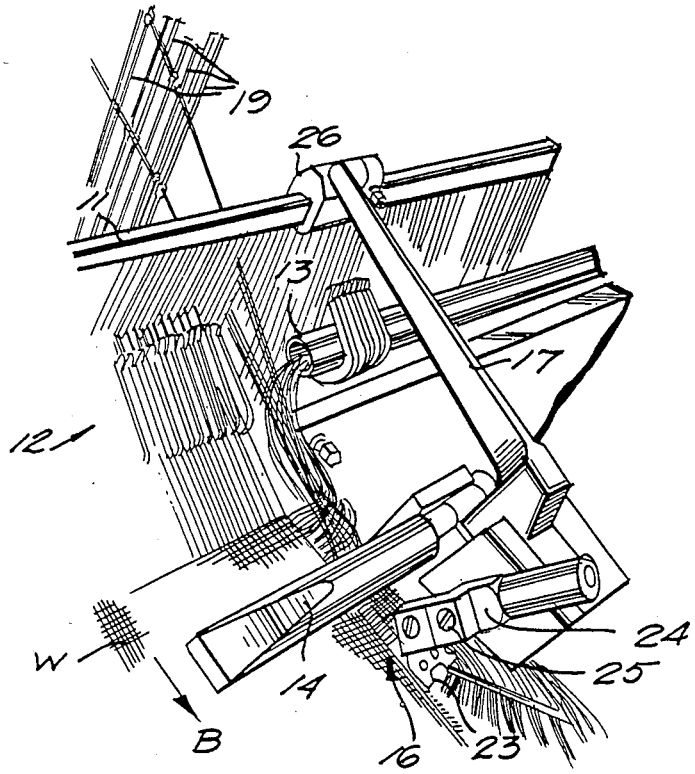
Fig. 2 PRIOR ART
FIG. 2 is a detail view of the right-hand temple area of the prior art loom of FIG. 1 when the reed and suction conduit are at their upstreammost position.
Figure 3:
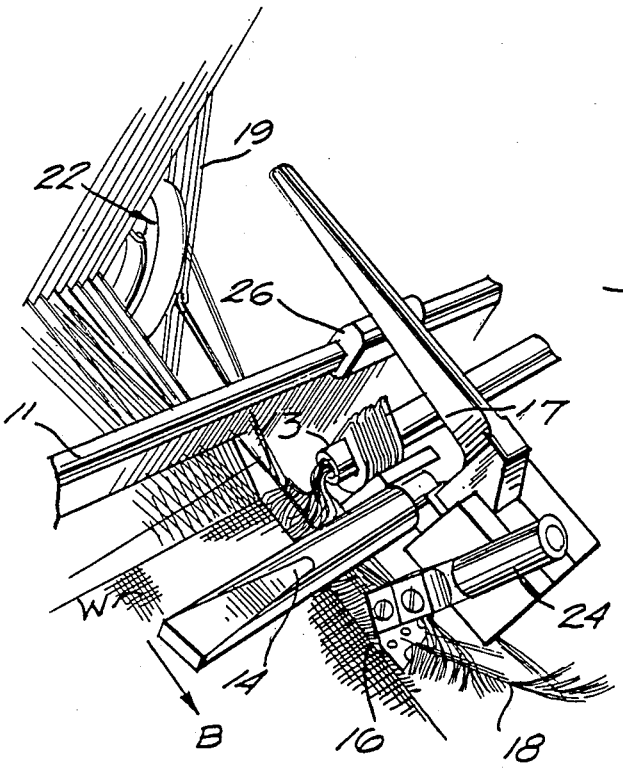
Fig. 3 PRIOR ART
FIG. 3 is a view identical to that of FIG. 2 except that the reed and suction conduit of the prior art loom are near their downstreammost position.

FIGS. 2 and 3 show the right-hand components of the prior art loom of FIG. 1 in more detail. For instance the cutting mechanism 16 includes blade 23 mounted to cutter arm 24 which is rotatable with the actuating arm 17 about the axis defined by the common shaft 25. An upstanding cam portion 26 is disposed on the top of the reed 11, and thus as the reed 11 moves forward and downward from its upstreammost position (FIGS. 1 and 2) toward its downstreammost position (FIG. 3), the cutting blade 23 moves out of engagement with the fringe of the fabric W, and then as the reed 11 moves backward and upward toward the upstreammost position (FIG. 2) the cutting blade 23 is lowered into cutting association with the fringe. The cut fringe is meanwhile being drawn away by the auxiliary binder ends 18.

In the conventional loom of FIGS. 1 through 3, the interposition, upstream to reed 11, of the side-by-side combination of the rotary interlacer 22 (see FIG. 3) for the fabric selvage and of heddles 19 for binder ends 18 puts a substantial limitation on how close suction conduit 13 can be put to the exit of confuser 12. Heddles 19 and their associated ends 18 themselves occupy width on the loom. More significantly, they cannot intrude toward the left on the space behind reed 11 occupied by the rotary interlacer. The combined lateral space occupied by the interlacer and the heddles 19 thus necessitates the placement of the suction conduit 13 nozzle entrance at least about 0.5 inch away from the exit aperture of the confuser 12. This relatively large spacing can result in errant picks (those riding significantly off center when they exit the approximately 0.875 inch wide exit aperture of the confuser 12) shooting outside the suction nozzle altogether. Additionally significantly less than the full length of the fringe extends into the nozzle for tensioning of the pick. As a result, particularly at high loom speeds, the pick fringe must be relatively long (e.g. 4–4.5 inches), so that for certain fabric widths up to 9% of the filling yarn length becomes waste. In these prior art constructions the diameter of the suction conduit 13 is substantially constant, and about 0.625 inches.

The Invention

The invention will now be described with respect to FIGS. 4–14. Components of the invention generally functionally equivalent to the components of the prior art loom (described above) are illustrated by the same reference numeral only preceded by a "1" or "2".

One distinction between the invention and the mechanical and fabric components of the art illustrated in FIGS. 1 through 3 is the elimination in the invention of binder ends 18, and with them their associated auxiliary heddles 19. With binder ends 18 gone from the invention, they no longer stand as impediments against moving suction conduit 13 leftward toward confuser 12. Additionally, besides the with formerly taken up by the binder ends, the invention also permits saving most of the width of rotary interlacer 22. This additional saving is possible because entrance 31 of suction conduit nozzle 113 (see FIG. 4) has been moved even farther to the left, so that not only has it crossed the space once occupied by binder ends 18, but it now underlaps rotary interlacer 22. It thereby effectively eliminates two side-by-side and thus additive spaces; i.e., the lateral spaces taken up by binder ends 18 and rotary interlacer 22. The underlapping was impossible as long as the lateral placement of binder ends 18 was fixed by the location of auxiliary heddles 19, which in turn were forbidden to move leftward into the space occupied by rotary interlacer 22.

According to the invention the entrance 31 to suction conduit nozzle 113 is placed significantly closer to the exit of confuser 12 than the at least 0.5 inch of the art, the entrance 31 preferably being placed about 0.125 inch from the confuser exit.

Figure 4:
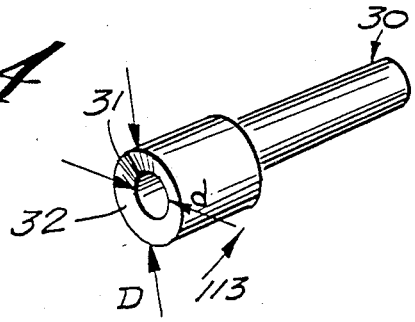
FIG. 4 is a perspective view looking in toward the entrance of an exemplary suction conduit nozzle according to the present invention.

Another distinction between the invention and the structure illustrated in FIGS. 1 through 3 in the design of the suction conduit nozzle 113 (see FIG. 4). The nozzle 113 is constructed so that the interior diameter d of the throat 30 thereof is reduced vis-a-vis the prior art nozzle from about 0.625 inch to about 0.3–0.5 inch. Too small a hole (i.e. significantly less than 0.3 inch) is likely to clog up. This significant reduction increases the nozzle air speed and thus the tension on the leading ends of the filling yarn F.

The entrance to the suction conduit nozzle 113 is constructed so that is has a diameter D which is substantially greater than the throat interior diameter d, and also significantly greater than the prior art 0.625 inch nozzle diameter. Preferably D is greater than 0.875 inch maximum dimension exit aperture for the confuser 112. For instance the diameter D of the entrance 31 of nozzle 113 is preferably about 1 inch.

A sloping surface 32 extends between the entrance 31 and the throat 30 to provide for guiding of errant picks into the throat 30. As seen in FIG. 4 the surface 32 preferably comprises a conical surface, such as one having an approximately 45° taper.

The combination of the construction of the nozzle 113 and its placement vis-a-vis the confuser 112, according to the present invention, provides for better pick capture and, for a given pick length, allows a greater percentage of the pick fringe yarn to extend into the suction conduit nozzle than was previously the case.

For comprehending the disposition, construction, and mode of operation of the cutter of the invention, and in particular its differences from the corresponding aspects of the conventional Elitex cutter of the art, it is essential to recognize first the significance of the two different general locations of the cutters. In the art the cutter is placed downstream with respect to the right temple 14, while in the present invention it is upstream with respect to a temple stub 114.

In the art, binder ends 18 serve to support and carry along the yarns of the fringe of fabric W. Since the supporting and conveying functions are served equally well both before and after the fringe is severed from the fabric, the location of the point of severing is not critical. In other words it seemingly is only a matter of convenience whether severing takes place more or less distant from the fell of the fabric. In the art the cutter is located 2½ to 3 inches downstream from the fell, which means that with typical fabrics, depending on the number of filling yarns or picks per inch, there may be as many as 100–200 uncut pick yarns in the fringe at all times during weaving. Such a cutter location and fringe condition are readily seen in FIG. 3.

In the invention, with no binder ends present, the location of cutting blade 123 is important. Fringe cutting mechanism 116 is placed upstream of temple stub 114 114, with cutting blade 123 located as close to the fell G of the fabric [preferably no more than 0.125 inch from it] as can be achieved without collision of the blade or its anvil 42 with reed 11 or suction conduit nozzle 113, as the latter more forward during weaving. To this end, where cutting blade 23 of the art is even fixed to the downstream side of cutting mechanism 16 (FIGS. 2 and 3), cutting blade 123 of the invention is fixed so as to point upstream from cutting mechanism 116 (FIGS. 5–7) and is brought as close as possible to the fell G.

Thus another significant distinction between the invention and the prior art loom of FIGS. 1 through 3 is the particular construction and disposition of the fringe cutting mechanism 116, which taken together contribute greatly to the effectiveness of suction conduit nozzle 113 as the sole fringe removal device in the mechanism of the invention. With particular reference to FIGS. 5 through 10 a first embodiment of the fringe cutting mechanism 116, and related components, according to the invention will now be described.

Figure 5:
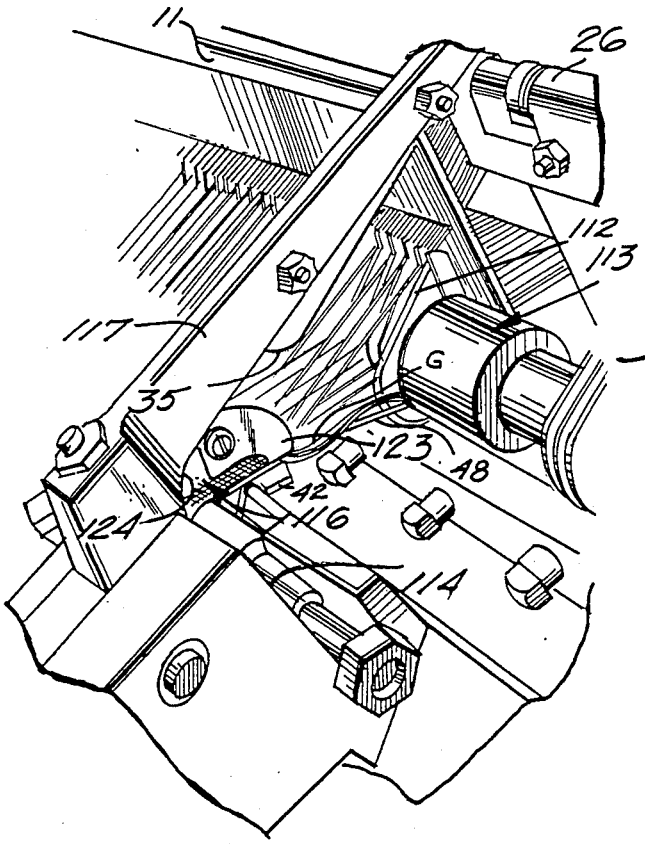
FIGS. 5–7 are perspective detail views showing operation of the fringe cutting mechanism and waste fringe removal mechanism according to the present invention in progressive positions as the reed and suction conduit move from their upstreammost position (FIG. 5) to their downstreammost position (FIG. 7)
Figure 6:
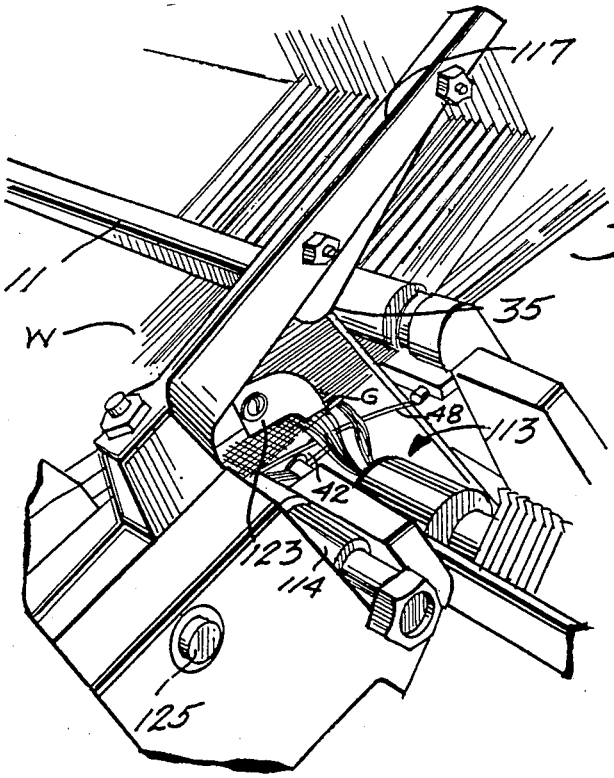

The fringe cutting means 116 includes a cutter arm 124 to which the razor blade cutting element 123 is mounted. The cutting element 123 is positioned upstream of the temple stub 114 vis-a-vis the direction of web W movement, and adjacent the suction conduit nozzle 113 at its downstreammost position (see FIG. 7). Further, the actuating arm 117 and the reed 11 element or cam 26 are constructed so as to provide surface means for effecting actuation of the cutting element 123 to effect fringe cutting during the downstream movement (just short of the downstreammost position) of the reed 11. In the embodiment illustrated in FIGS. 5 through 10, such surface means comprises a cam follower 35 which is connected as a separate piece of the arm 117. As can be seen by an inspection of the progressive movement of the components illustrated in FIGS. 5 through 7, at the upstreammost position of the reed 11 the cam 26—engaging the cam follower 35—holds the cutting element 123 above the fringe yarn to be cut, and it is raised even farther above the fringe yarn as the reed 11 moves to an intermediate position (FIG. 6). However, once the downstreammost end of the cam follower 35 is passed by the cam 26, the cutting element 123 moves abruptly downwardly (see FIG. 7) to effect fringe cutting.

The abrupt cutting action initiated by the movement of cam follower 35 across cam 26 is completely unlike the cutting action in the art. In the latter, as noted hereinabove, cutting takes place during the return of reed 11 to its upstreammost position (FIG. 2), typically somewhere above the midpoint of the return movement. Given the presence of binder ends 18 as the means for holding the up to 200 or so filling or pick fringe yarns in place prior to cutting, there seems to be no need for a precise cutting point in the weaving cycle of the prior art. Indeed the actual cutting of a given pick occurs after that pick has moved far downstrem from the fell of the fabric, and after it has long since passed outside the working range of suction conduit 13.

According to the invention, in the absence of fringe binder yarns, successful and maximum shortening of the pick yarns depends upon cutting the fringe while it is still strongly under the influence of suction conduit nozzle 113. To achieve this strong influence it is important not only to station cutter blade 123 close to the fell G of the fabric, as described hereinabove, but also to trigger the cutting at a point where suction conduit nozzle 113 is also close to the fell, at which point the suction effect on the fringe filling yarns already beaten into fabric W by reed 11 is at its maximum. As reed 11 moves forward toward the fell G, and the associated confuser 12 and suction conduit nozzle 113 curve downward to a point slightly below the fell, the downstream end of cam follower 35 triggers the abrupt downward cutting action of cutter blade 123 at or near the closest point of approach of the nozzle to the fell. This point is reached just before the reed reaches its downstreammost turnaround position.

The maximum suction exerted by suction conduit nozzle 113 upon a given fringe yarn at the fell comes at the time of beating-in, because at that time the trailing fringe extends most deeply into the nozzle. As the reed and associated suction nozzle continue in their cycle back toward their upstreammost position, the trailing pick fringe is pulled outward from the nozzle because the pick itself is now fixed in the fabric. The length of each pick in the fringe can be no less than that required to maintain control of the fringe by the suction conduit nozzle, including the capability of the nozzle to carry away each fringe yarn as it is severed from the fabric. Besides the in-and-out motions of the pick fringes within nozzle 113 as the result of successive cycles of reed 11, the farther downstream a given pick proceeds as succeeding picks are beaten into the fabric, the less of it remains in the nozzle and the smaller the effect of the suction on it becomes, even when the nozzle is closest to the fell G.

Because of the aforediscussed close placement of cutting blade 123 to the fell G, the invention provides for severing the fringe yarns, on the average of one per reed cycle, while only about one to ten of them remain unsevered downstream from the fell G. The close-up severing and maximized suction at the time of severing provide a large part of the benefits of the invention.

The arm 124 and the cutting element 123 can best be seen with respect to FIG. 8. Note that the elongated slot 37 in the cutter arm 124 allows for adjustment of the horizontal position thereof with respect to the common shaft 125 joining it and the actuator arm 117. Further, the vertical position of the cutting element 123, as well as its angular orientation, may be adjusted with respect to the arm 124 in view of the elongated slot 39 formed in element 123, and cooperating with the screw 40 which passes through it and threadingly engages the arm 124.

The stationary components of the fringe cutting mechanism 116 are perhaps best illustrated in FIGS. 9 and 10. They include an anvil, which comprises a block of material 42, having a yarn supporting surface 43 thereof, and mounted by brackets 44 and 47 so that it is stationary with respect to the cutting element 123. As illustrated in the drawings, it is preferred that the bracket 44 be mounted to the temple stub 114 by means of L-shaped bracket 47, and both brackets may be adjustable with respect to the temple 114 (see elongated slot 45 in bracket 44 (FIG. 10), and screws 46 and 49 (FIG. 9) which cooperate therewith).

Note that the temple stub 114 according to the invention is significantly shorter than the temple 14 of the conventional prior art loom, the result of cutting off the left end of conventional temple 14. With the relatively heavy 32-pick-per-inch glass fabric being made herein as an example, the function of temple stub 114 for controlling the fabric edge is relatively unimportant. The truncation of temple 14 to make temple stub 114 essentially eliminates its function as a temple, making it simply a convenient base for the close-in mounting of cutting mechanism 116. Were a fabric to be made which would require the conventional controlling of temple 14, another means for mounting the cutter, such as using the temple support, could easily be devised by one of ordinary skill, given the teachings of the invention.

In the weaving of many fabrics on the modified loom of the invention it is possible to omit the fringe lifting means 48 or 248, particularly shown in the preferred embodiments of FIGS. 9, 12, 14 and 15. In the absence of the lifting means, careful attention to the shaping and precise placement of cutting block 42 will ensure the full benefits of the invention. However, in order to simplify and to provide better for the proper positioning of fringe yarn to be cut on the yarn supporting surface 43, a lifting means is preferably associated with the block 42. This lifting means preferably takes the form of a wire or ramp 48, the wire 48 also being connected to the temple stub 114—as by screw 49 (see FIG. 9). Piano wire (0.050–0.075" diameter) is a material of choice. The manner in which the member 48 functions to effect lifting is best seen with respect to FIGS. 6 and 7, where it is clear that it functions as a ramp to lift up and guide fringe yarn to be severed to the level of the thread supporting surface 43 of anvil block 42, so that the yarn is properly supported for severing by the cutting element 123 moving into contact with the block 42.

Another function of lifting member 48 is to guide all the uncut fringe yarns in such a way as to help insure their being in optimum position with respect to suction conduit nozzle 113 at the time of cutting. Although some degree of variation is permissible it is believed desirable to have the fell of the fabric, the cutting point, and suction conduit nozzle 113 in essentially the same vertical plane at the time of cutting. The goal of this positioning, preferably aided by lifting member 48, is to assure the benefits of having each fringe yarn substantially perpendicular to cutting blade 123 at the time it is cut.

Although it is not important to design lifting member 48 so that it cannot bump into reed 11 at their point of closest contact, it is convenient in most cases to avoid the possibility of contact by either terminating the reed at the right edge of the fabric, of alternatively removing two or three dents in the region of the lifting member. Appropriate dent removal will make it possible for lifting member 48 to infringe on the plane of reed 11 without danger of actual contact. There is obviously no need to provide for possible contact between reed and lifting member if no lifting member is employed.

Whatever provision may be made for the prevailing conditions, it must leave a position on the reed, a reed segment, or some other spot associated with the reed motion, for the mounting of cam 26 or 226.

Another embodiment of the fringe cutting mechanism, and associated components, according to the present invention is illustrated in FIGS. 11 through 15. In this embodiment components generally comparable in function to components of the FIGS. 5 through 10 embodiment are indicated by the same two digit reference numeral only preceded by a "2".

In the FIGS. 11 through 15 embodiment, the surface means cooperating between the actuating arm 217 and the cam 226 is different than for the FIGS. 5 through 10 embodiment. In particular, the cam 226 is formed so that it has a generally pointed top 50, and the arm 217 is formed so that it has means defining a recess 51 therein. Thus as the reed 11 moves downstream the cam 226 lifts the arm 217 until the pointed top 50 of the cam 226 enters recess 51, at which point the arm 217 drops abruptly, effecting rotation of shaft 225 about its axis (which extends essentially perpendicular to the direction B) so that the arm 224 moves downwardly, and the cutting element 223 into cutting association with the block 242 (see FIG. 12 in particular).

In the FIGS. 11 through 15 embodiment, the lifting means 248 is essentially identical to lifting means 48, only the construction and attachment of the bracket mounting the block 242 are changed. In this embodiment the bracket 244 comprises a substantially flat main plate 253 which has a generally perpendicularly extending portion 254 along one edge thereof. Elongated slots 245 allow adjustment of the position of the bracket 244 with respect to the temple stub 214 by means of screws 246. The block 242 is mounted so that it engages both the plate 253 and the edge portion 254 (see FIGS. 14 and 15 in particular). Temple stub 214 is turned over so that its flat bottom surface, tapped for screw 255, now faces upwardly thereby providing an attachment plane for mounting block 247. Block 247 is tapped with two holes for screws 246 and has a slot 256 for screw 255, thereby providing a second direction of adjustment for bracket 244.

FIG. 13 shows the shaft 225 interconnecting actuating arm 217 and cutter arm 224, the cutter arm being held on by screw 227 and being horizontally adjustable by means of elongated slot 237.

Operation

Figure 7:
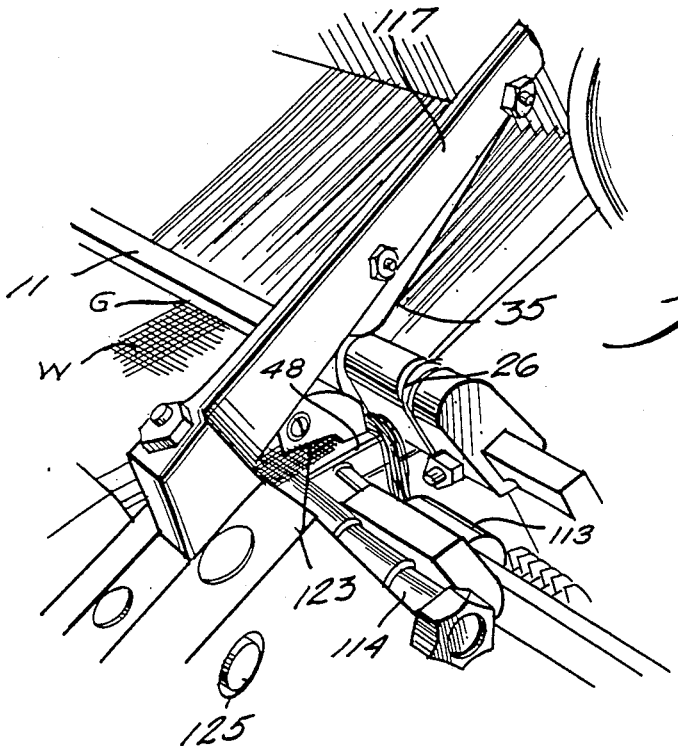
Figure 11:
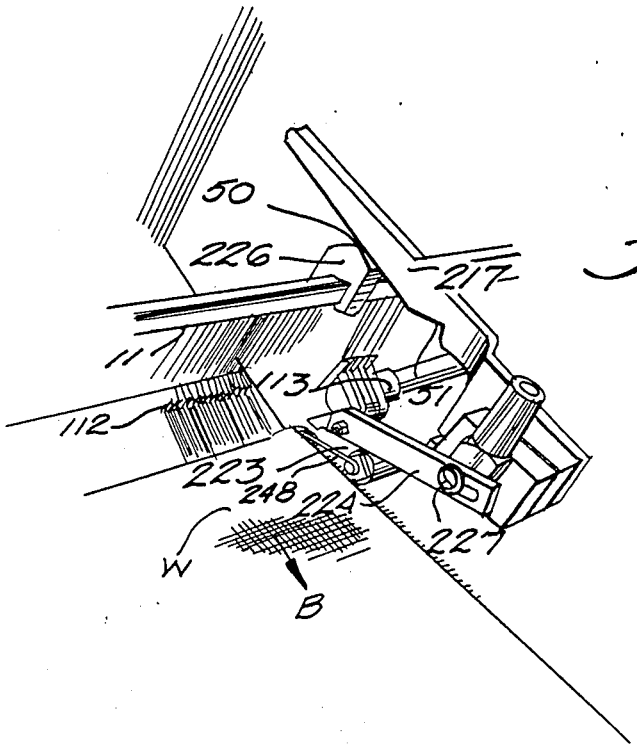
FIG. 11 is a perspective view of another embodiment of the fringe cutting mechanism according to the invention in association with the rest of the components of an air jet loom.

Exemplary operation of the invention will now be described with respect to FIGS. 5 through 7.

Filling yarns F are expelled from the main jet of the loom inverted into successive sheds and, ultimately passed to the suction conduit with the suction conduit nozzle 113 in its upstreammost position. The reed 11 suction, conduit nozzle 113, and like components are then reciprocated in the direction B (i.e. downstream with respect to the direction of fabric movement) with the filling yarn held by the suction conduit nozzle 113. During this movement, the cam follower 35 engages the cam 26 on the reed 11 and is moved upwardly, and once the cam follower 35 is passed, the arm 117 moves downwardly abruptly. This abrupt downward movement of the arm 117 effects rotation of the shaft 125, which in turn effects downward rotation of the center arm 124 bringing the cutting element 123 into cutting engagement with respect to filling yarn held by the suction conduit nozzle 113 adjacent thereto, and supported by the thread severing surface 43 of the block 42.

The cut fringe is withdrawn through the suction conduit suction 113 and ultimately passes to the suction source 15, and to disposal.

In this way the amount of waste is minimized, no auxiliary binder yarns being necessary, and the suction conduit nozzle 113 being positionable with respect to the exit from the confuser 112 and dimensioned so that untrimmed filling yarns will be tightly held.

As is conventional, continuous defect-free weaving is dependent upon each successive filling yarn or pick being detected during its insertion cycle by a filling detector (such as an optical beam) operatively disposed in association with the gap in the top of the last confuser rib. In both the conventional loom and the loom of the invention, the detector is triggered by the passage of each newly inserted pick, just before it is beat into the fell of the fabric, through the detector beam. This passage occurs when the top of the confuser, during its movement forward and downward to a position beneath the shed, drops below the plane of the fabric. If the beam is not intercepted by the pick at this time, the loom automatically stops.

In the conventional loom the pick fringe and its individual pick members are supported by fringe binder ends 18 substantially in the plane of the fabric until the fringe is cut off, many picks below the fell G. The binder ends, by keeping a portion of the entire fringe planar, help to insure the passage of each new pick through the filling detector beam at the proper time. According to the invention, in the absence of binder ends 18, the passage of suction conduit nozzle 113 through the plane of the fabric tends to draw the latest pick fringe yarn downward just at the time when that pick needs to be tripping the filling detector. Thus, without some aid to the consistent functioning of the filling detector, experience shows that with some fabrics an unacceptable level of loom stoppages may occur because of erratic movement of the fringe yarns with respect to the action of the filling detector.

In the invention, not only does lifting member 48 assure the proper positioning of each pick on cutter block 42 or 242 at the time of cutting, as detailed hereinabove, but it also assures the consistently dependable operation of the filling detector. By holding the pick fringes in substantially the same plane as they conventionally would be held by the fringe binder ends, lifting member 48 guards against loom stoppages resulting from false indications of pick insertion failure.

Once the reed 11 has reached the end of its stroke of travel in the direction B, it moves back toward its original position (FIG. 5) while another filling yarn or pick is passed from the main jet to the nozzle 113.

Application of the teachings of the invention results in the elimination of all of the auxiliary fringe binder ends and their associated machine elements together with, depending upon the fabric being made, reductions of about 30–40% in the amount of filling fringe waste.

It will thus be seen that according to the present invention an air jet loom, and component parts thereof, have been provided which effect the simple and effective operation of the loom with minimum waste of material. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. An air jet loom for weaving fabric including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said suction conduit mounted on the opposite side of said reed from said main jet and adapted to receive and successively retain a plurality of said filling yarns, all but the upstreammost one of which having been beaten into the fabric fell; fringe cutting means including a fringe cutting element mounted on the same side of said fabric being woven as said suction conduit; an actuating arm operatively connected to said fringe cutting means for effecting fringe cutting in response to reed movement; said cutting element of said fringe cutting means located adjacent said suction conduit when said suction conduit moves to a downstreammost position; and cam surface means on said actuating arm for engaging with cam means on said reed for effecting movement of said cutting element to cut said fringe during downstream movement of said reed; said cam surface means and said fringe cutting means being positioned with respect to the length of travel of said reed and said suction conduit, and with respect to the fell of the fabric, so that on the average, only the downstreammost of the plurality of yarns retained in the suction conduit is severed per reed cycle, the remaining yarns of said plurality of yarns remaining unsevered and upstream of said fringe cutting means.

2. An air jet loom as recited in claim 1 wherein cut fringe is removed by said suction conduit and connected suction source.

3. An air jet loom as recited in claim 1 wherein said fringe cutting means comprises a cutter arm mounting said cutting element, said cutting element comprising a blade, and said arm rotatable about an axis substantially perpendicular to the direction of woven fabric movement; and a stationary block with which said blade cooperates to effect fringe cutting.

4. An air jet loom as recited in claim 3 further comprising lifting means operatively associated with said block, said lifting means comprising means for lifting fringe to be cut into proper operative position on said block.

5. An air jet loom as recited in claim 1 wherein the cutting point of said cutting means, the fell of the fabric being woven, and said suction conduit are in substantial vertical alignment when the reed is in its downstreammost position.

6. An air jet loom as recited in claim 1 further comprising a temple stub mounted on the same side of said reed as said suction conduit and downstream thereof in the direction of woven fabric movement, and wherein said cutting element is mounted upstream of said temple stub in the direction of fabric movement.

7. An air jet loom as recited in claim 1 further comprising a confuser having a dimension of a given exit and opening, said exit end portion adjacent said suction conduit, and wherein said suction conduit includes a nozzle end, said nozzle end having an entrance dimension significantly greater than said confuser exit opening dimension, and having a throat dimension significantly less than said entrance dimension, with a tapered surface in between said entrance and said throat, so that any errant filling yarns from said main jet are properly guided into the nozzle, and so that tension on the leading end of the filling yarn is maximized.

8. An air jet loom as recited in claim 7 wherein said surface extending between said nozzle entrance and said throat is conical.

9. An air jet loom as recited in claim 7 and wherein the entrance to said suction conduit is significantly closer than about 0.5 inch to said confuser exit end so that pick fringe length can be minimized.

10. An air jet loom for weaving fabric including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said suction conduit mounted on the opposite side of said reed from said main jet and adapted to receive and successively retain a plurality of said filling yarns, all but the upstreammost one of which having been beaten into the fabric fell; fringe cutting means including a fringe cutting element mounted on the same side of said fabric being woven as said suction conduit; an actuating arm operatively connected to said fringe cutting means for effecting fringe cutting in response to reed movement; said cutting element of said fringe cutting means located adjacent said suction conduit when said suction conduit moves to a downstreammost position; and cam surface means between said actuating arm and said reed for effecting movement of said cutting element to cut said fringe during downstream movement of said reed; said cam surface means and said fringe cutting means being positioned with respect to the length of travel of said reed and said suction conduit, and with respect to the fell of the fabric, so that on the average, only the downstreammost of the plurality of yarns retained in the suction conduit is severed per reed cycle, the remaining yarns of said plurality of yarns remaining unsevered and upstream of said fringe cutting means, wherein said fringe cutting means comprises a cutter arm mounting said cutting element, said cutting element comprising a blade, and said arm rotatable about an axis substantially perpendicular to the direction of woven fabric movement; and a stationary block with which said blade cooperates to effect fringe cutting, and wherein said suction conduit includes a nozzle end, said nozzle end having an entrance diameter significantly greater than 0.875 inch, and having a throat with a diameter of about 0.3–0.5 inch, with a tapered surface in between said entrance and said throat, so that any errant filling yarns from said main jet are properly guided into the nozzle, and so that tension on the leading end of the filling yarns is maximized.

11. An air jet loom as recited in claim 10 further comprising a confuser having an end portion thereof adjacent said suction conduit; and wherein the entrance to said suction conduit is significantly closer than about 0.5 inch to said confuser exit end so that filling yarn fringe length can be minimized.

12. An air jet loom for weaving fabric, including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said conduit mounted on the opposite side of said reed from said main jet, fringe cutting means mounted on the same side of said fabric being woven as said suction conduit; an actuating arm operatively connected to said fringe cutting means for effecting fringe cutting in response to reed movement; and said fringe cutting means having a cutting element thereof located adjacent said suction conduit when said suction conduit moves to a downstreammost position so that cut fringe is removed by said conduit, and said fringe cutting means further comprising: a cutting arm mounting said cutting element, said cutting element comprising a blade, and said arm rotatable about an axis substantially perpendicular to the direction of woven fabric movement a stationary block with which said blade cooperates to effect fringe cutting; and lifting means operatively associated with said block, said lifting means comprising means for lifting fringe to be cut into proper operative position on said block; and cam surface means on said actuating arm for engaging with cam means on said reed for effecting fringe cutting movement of said fringe cutting means cutting element during downstream movement of said reed.

13. An air jet loom as recited in claim 12 wherein said lifting means comprises a stiff wire extending outwardly from said block in the upstream dimension with respect to the direction of fabric movement.

14. An air jet loom as recited in claim 12 further comprising a temple stub mounted on the same side of said reed as said suction conduit and downstream thereof in the direction of woven fabric movement, and wherein said cutting element is mounted upstream of said temple stub in the direction of fabric movement; and wherein said block and said lifting means are operatively connected to said temple stub.

15. An air jet loom for weaving fabric, including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said suction conduit mounted on the opposite side of said reed from said main jet and adapted to receive and successively retain a plurality of filling yarns, all but the upstreammost one of which having been beaten into the fell; fringe cutting means mounted on the same side of said fabric being woven as said suction conduit; an actuating arm operatively connected to said fringe cutting means for effecting fringe cutting during downstream movement of said reed; said suction conduit and said suction source comprising sole means for tensioning said fringe during cutting and for removing cut fringe; said fringe cutting means being positioned with respect to the length of travel of said suction nozzle and said reed, and with respect to the fell of the fabric, so that on the average, only the downstreammost of the plurality of yarns retained in the suction conduit is severed per reed cycle, the remaining yarns of said plurality of yarns remaining unsevered and upstream of said fringe cutting means.

16. An air jet loom as recited in claim 15 further comprising a confuser having a dimension of a given exit and opening, said exit end portion adjacent said suction conduit, and wherein said suction conduit includes a nozzle end, said nozzle end having an entrance dimension significantly greater than said confuser exit opening dimension, and having a throat dimension significantly less than said entrance dimension, with a tapered surface in between said entrance and said throat, so that any errant filling yarns from said main jet are properly guided into the nozzle, and so that tension on the leading end of the filling yarn is maximized.

17. An air jet loom as recited in claim 15 and wherein the entrance to said suction conduit is significantly closer than about 0.5 inch to said confuser exit end so that filling yarns fringe length can be minimized.

18. An air jet loom as recited in claim 16 wherein said surface extending between said nozzle entrance and said throat is conical.

19. An air jet loom as recited in claim 15 wherein said fringe cutting means comprises a rotatable cutter arm having a blade cutting element

20. An air jet loom for weaving fabric, including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said conduit mounted on the opposite side of said reed from said main jet, and adapted to receive and successively retain a plurality of filling yarns, all but the upstreammost one of which having been beaten into the fell; fringe cutting means mounted on the same side of said fabric being woven as said suction conduit; an actuating arm operatively connected to said fringe cutting means for effecting fringe cutting during downstream movement of said reed; a confuser having an exit opening of a given dimension; said suction conduit and said suction source comprising sole means for tensioning said fringe during cutting and for removing cut fringe;

wherein said suction conduit includes a nozzle end, said nozzle end having an entrance dimension significantly greater than said confuser exit opening dimension, and having a throat dimension significantly less than said entrance dimension, with a tapered surface in between said entrance and said throat, so that any errant filling yarns from said main jet are properly guided into the nozzle, and so that tension on the leading end of the filling yarns is maximized.

21. An air jet loom for weaving fabric, including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said conduit mounted on the opposite side of said reed from said main jet, and adapted to receive and successively retain a plurality of filling yarns, all but the upstreammost one of which having been beaten into the fell; fringe cutting means mounted on the same side of said fabric being woven as said suction conduit; an actuating arm operatively connected to said fringe cutting means for effecting fringe cutting during downstream movement of said reed; a confuser having an exit opening of a given dimension; and waste fringe means for removing cut fringe; and means including said suction conduit, for removing the cut fringe;

wherein said suction conduit includes a nozzle end, said nozzle end having an entrance dimension significantly greater than said confuser exit opening dimension, and having a throat dimension significantly less than said entrance dimension, with a tapered surface in between said entrance and said throat, so that any errant filling yarns from said main jet are properly guided into the nozzle, and so that tension on the leading end of the filling yarns is maximized, wherein said surface extending between said nozzle entrance and said main body opening is conical and wherein said entrance dimension is greater than about 0.875 inch and said throat dimension is about 0.3–0.5 inch.

22. An air jet loom as recited in claim 20 wherein said nozzle entrance of said suction conduit is significantly closer than about 0.5 inch to said confuser exit opening so that filling yarn fringe length can be minimized.

23. A yarn severing mechanism comprising:

a cutting blade having an edge;

an anvil having a yarn supporting surface, said yarn supporting surface including a block of material;

an arm supporting said cutting blade and rotatable about an axis;

means for effecting rotatable movement of said arm about said axis so that said blade edge comes into contact with said yarn supporting surface, severing any yarn supported thereon; and a stiff wire operatively connected at one end thereof adjacent said anvil, and having a free end thereof extending outwardly from said anvil generally perpendicular to said axis of rotation, said wire comprising means for providing a ramp surface leading from a point outward of said anvil up to said yarn supporting surface of said anvil, so that it moves a yarn into position over said anvil so that the yarn is essentially perpendicular to said blade and thus in position for proper cutting.

24. A mechanism as recited in claim 23 wherein said anvil and said stiff wire are operatively connected to a temple stub of a shuttleless loom.

25. A mechanism as recited in claim 24 wherein said anvil is operatively connected to said temple stub by a bracket having a flat plate body portion, and having a perpendicular supporting projection formed along one edge thereof, said block operatively engaging both said perpendicular surface and said plate.

26. An air jet loom for weaving fabric including: a main jet for inserting successive filling yarns into successive sheds; a reed moveable both downstream and upstream with respect to the direction of fabric movement for beating and filling yarns into the fell of the fabric being woven; a suction conduit moveable with said reed and operatively connected to a suction source, said conduit mounted on the opposite side of said reed from said main jet, and adapted to receive and successively retain a plurality of filling yarns, all but the upstreammost one of which having been beaten into the fabric fell; fringe cutting means mounted on the same side of said fabric being woven as said suction conduit;

an actuating arm operatively connected to said fringe cutting means for effecting fringe cutting in response to reed movement; said fringe cutting means having a cutting element thereof located adjacent said suction conduit when said suction conduit moves to a downstreammost position so that cut fringe is removed by said conduit; and cam surface means cooperating between said actuating arm and said reed for effecting fringe cutting movement of said fringe cutting means cutting element during downstream movement of said reed, said cam surface means cooperating between said actuating arm and said reed comprising an upstanding generally pointed cam on said reed, and means defining a recess in the bottom of said actuating arm for operatively receiving said cam as said reed approaches its downstreammost position with respect to the direction of fabric movement.

27. An air jet loom for weaving fabric including: a main jet for inserting successive filling yarns into successive sheds; a reed moveable both downstream and upstream with respect to the direction of fabric movement for beating said filling yarns into the fell of the fabric being woven; a suction conduit moveable with said reed and operatively connected to a suction source, said suction conduit mounted on the opposite side of said reed from said main jet and adapted to receive and successively retain a plurality of said filling yarns, all but the upstreammost one of which having been beaten into the fabric fell; fringe cutting means including a fringe cutting element mounted on the same side of said fabric being woven as said suction conduit; an actuating arm operatively connected to said fringe cutting means for effecting fringe cutting in response to reed movement; said cutting element of said fringe cutting means located adjacent said suction conduit when said suction conduit moves to a downstreammost position; and cam surface means between said actuating arm and said reed for effecting movement of said cutting element to cut said fringe during downstream movement of said reed; said cam surface means and said fringe cutting means being positioned with respect to the length of travel of said reed and said suction conduit, and with respect to the fell of the fabric, so that on the average, only the downstreammost of the plurality of yarns retained in the suction conduit is severed per reed cycle, the remaining yarns of said plurality of yarns remaining unsevered and upstream of said fringe cutting means, wherein said cam surface means cooperating between said actuating arm and said reed comprises an upstanding generally pointed cam on said reed, and means defining a recess in the bottom of said actuating arm for operatively receiving said cam as said reed approaches its downstreammost position with respect to the direction of fabric movement.

* * * * *